US005832614A

United States Patent [19]

Gallagher et al.

[11] Patent Number: 5,832,614

[45] Date of Patent: Nov. 10, 1998

[54] REMOTE LOWER GUARD LIFT LEVER MECHANISM FOR CIRCULAR SAWS

[75] Inventors: P. Sean Gallagher, Des Plaines; Sue H. Abdallah, Vernon Hills, both of Ill.

[73] Assignee: S-B Power Tool Company, Chicago, Ill.

[21] Appl. No.: 859,156

[22] Filed: May 20, 1997

[51] Int. Cl.[6] ..... B27G 19/04

[52] U.S. Cl. ..... 30/391; 30/390

[58] Field of Search ..... 30/390, 391, 376

[56] References Cited

U.S. PATENT DOCUMENTS

| | | | |
|---|---|---|---|
| 1,811,577 | 6/1931 | Crowe . | |
| 1,900,553 | 3/1933 | Hampton . | |
| 2,722,246 | 11/1955 | Arnoldy . | |
| 2,963,056 | 12/1960 | Richford | 30/391 |
| 3,441,067 | 4/1969 | Forcier . | |
| 3,701,369 | 10/1972 | Gronke et al. . | |
| 3,730,239 | 5/1973 | Kaman et al. . | |
| 3,733,701 | 5/1973 | Lubas | 30/391 |
| 3,787,973 | 1/1974 | Beisch et al. . | |
| 4,672,746 | 6/1987 | Zeilenga . | |
| 5,023,999 | 6/1991 | Looper et al. | 30/390 |
| 5,075,976 | 12/1991 | Young . | |
| 5,121,543 | 6/1992 | Onose et al. | 30/391 |
| 5,481,806 | 1/1996 | Pratt | 30/391 |

FOREIGN PATENT DOCUMENTS

| | | | |
|---|---|---|---|
| 269045 | 8/1966 | Australia | 30/330 |

*Primary Examiner*—Hwei-Siu Payer
*Attorney, Agent, or Firm*—Jones, Day, Reavis & Pogue

[57] ABSTRACT

A circular saw including a lower bladeguard which is retractable by a remotely operated mechanism. This mechanism includes a lever which is pivotally mounted adjacent an auxiliary handle for the saw. The operator may retract the lower bladeguard by depressing the lever with the operator's left thumb while continuing to grip the auxiliary handle.

4 Claims, 5 Drawing Sheets

REMOTE LOWER GUARD LIFT LEVER MECHANISM FOR CIRCULAR SAWS

The present invention relates to circular saws. More particularly, the present invention relates to a remote lower guard lift lever mechanism.

BACKGROUND OF THE INVENTION

Circular saws of the type under consideration include a motor, usually an electric motor, for driving a spindle rotatable about an axis. The saw blade employed with a saw of this type is circular and includes a continuous peripheral series of cutting teeth for cutting a workpiece when the blade is rotated in its own plane, a plane perpendicular to the axis of the spindle. The tool housing of the circular saw is provided with a primary handle, either a push type or a top type. Many circular saws are also provided with an auxiliary handle so that the operator can hold the circular saw with both hands during operation.

For safety reasons, circular saws include upper and lower fixed and movable blade guards, respectively. The upper fixed blade guard is normally mounted on the tool housing and covers an approximate 180 degree peripheral portion of the blade. The movable lower guard is swingable between closed and open positions. In the closed position, the lower guard encloses a substantial part of the other 180 degree peripheral portion of the blade. When the lower guard is in its full open position, an approximate 180 degree peripheral portion of the saw blade is exposed.

The above described circular saws include both direct and remote lift mechanisms for the lower blade guard. A direct lift mechanism includes a knob or arm directly connected to the lower guard permitting the user to retract the lower guard by grasping knob or arm. Remote lift mechanisms are usually mounted adjacent the upper blade guard and include a linkage system connected to the lower guard. Representative prior art showing lower blade guard retraction mechanisms include U.S. Pat. Nos.: Crowe 1,811,577; Hampton 1,900,553; Arnoldy 2,722,246; Forcier 3,441,067; Kaman 3,730,239; Belsch 3,787,973; Zeilenga 4,672,746 and Young 5,075,976.

A problem with prior art remote lower guard lift mechanisms embodied in circular saws having primary and auxiliary handles resides in the fact that it is necessary for the operator to move his hand from, or at least substantially reposition his hand on, the auxiliary handle to actuate the lift mechanism. This removal or repositioning of the operator's hand is inconvenient and can create additional fatigue when operating the saw during long time periods.

SUMMARY AND OBJECTS OF THE INVENTION

The present invention provides a new and improved remote lower guard lift mechanism for circular saws of the type employing primary and auxiliary handles, permitting the operator to maintain a firm grip of both of the handles while actuating the lift mechanism.

A primary object of the present invention resides in the provision of a remote lower guard lift mechanism which may be actuated by the operator's left thumb while grasping the auxiliary handle of the circular saw with the left hand.

Another object of the present invention is provision of a remote lower guard lift mechanism of the type just described which includes a lost-motion linkage connection permitting continued opening movement of the lower guard, in response to engagement with the workpiece, after the lower guard has been opened by the lift mechanism to an intermediate position between its closed and fully opened positions.

Still another object of the present invention is the provision of a remote lower guard lift mechanism which requires few moving parts thus lending itself to inexpensive manufacture and highly reliable operation.

These and other objects and advantages of the present invention will be come apparent from the following specification.

DESCRIPTION OF A PREFERRED EMBODIMENT

Figure 1:
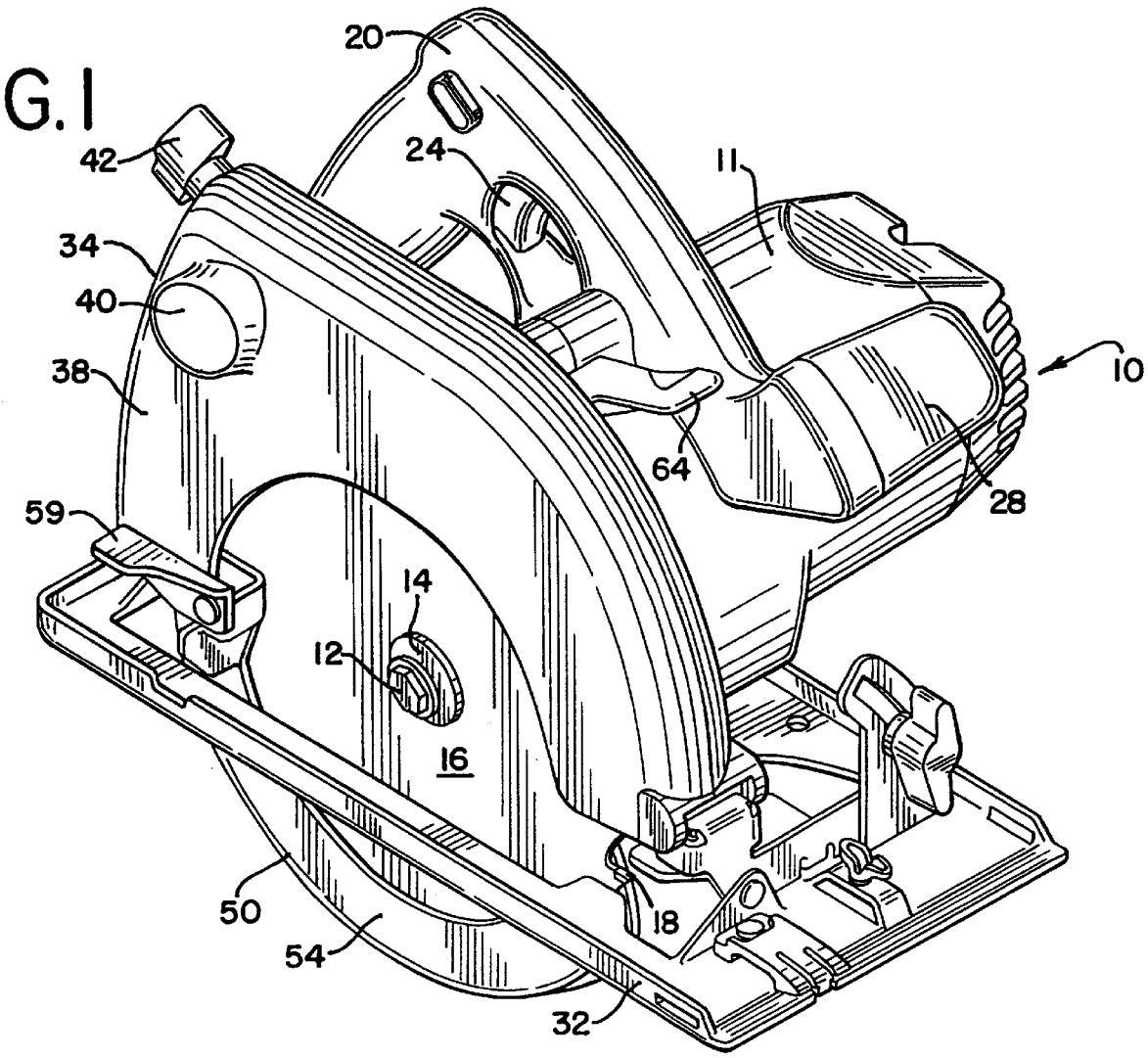
FIG. 1 is an isometric view of a circular saw embodying the present invention as seen from the front and right side of the circular saw.
Figure 2:
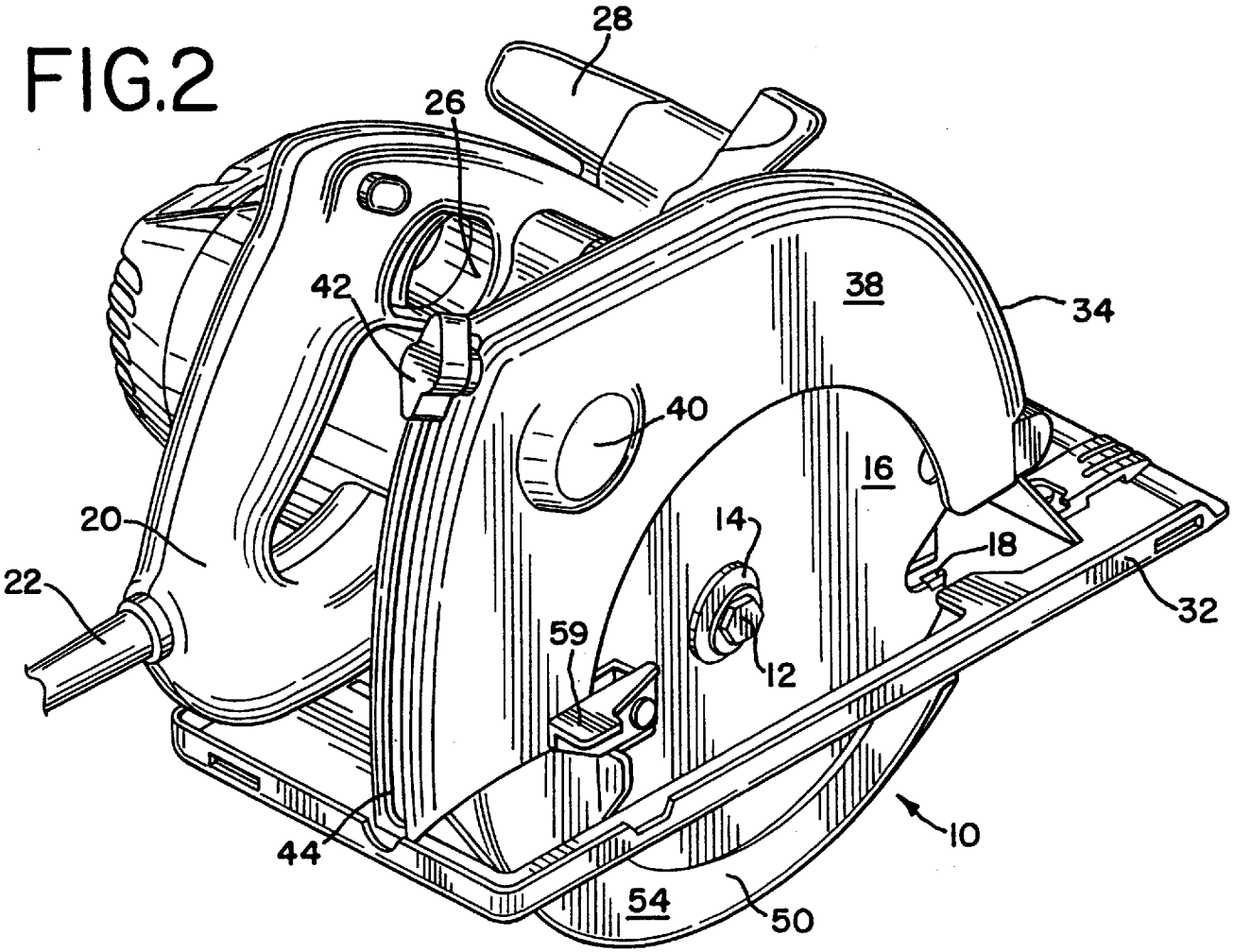
FIG. 2 is an isometric view of the circular saw as seen from the rear and right side thereof.

Referring primarily to FIGS. 1 and 2, a circular saw, generally designated 10, includes a housing 11 enclosing an electric motor (not shown). The motor includes an output shaft or spindle (not shown) receiving a fastener 12 and washer 14 for mounting a circular saw blade 16 to the spindle for rotation in the plane of the blade, a plane perpendicular to the axis defined by the motor output shaft and the spindle. It will be understood that the blade 16 is of conventional construction including a continuous peripheral series of cutting teeth. One tooth 18 can be seen in FIGS. 1 and 2.

Housing 11 mounts a primary handle 20 which is in the nature of a push handle. This handle receives the cord 22 for supplying electrical power to the electric motor of the circular saw. The handle 20 includes a trigger 24 received within an aperture 26. It will be understood that squeezing of the trigger 24 closes contacts (not shown) for energizing the tool motor. Housing 11 also includes an auxiliary handle 28, which in the embodiment shown, is integral with or is an extension of, the primary handle 20.

The circular saw includes the usual base plate 32 which is pivotal about a horizontal transverse axis (parallel with the motor output shaft) to control the depth of the cut. The base plate may also be pivoted about a longitudinal axis for bevel cutting, all in a manner well know to those skilled in the art.

Figure 4:
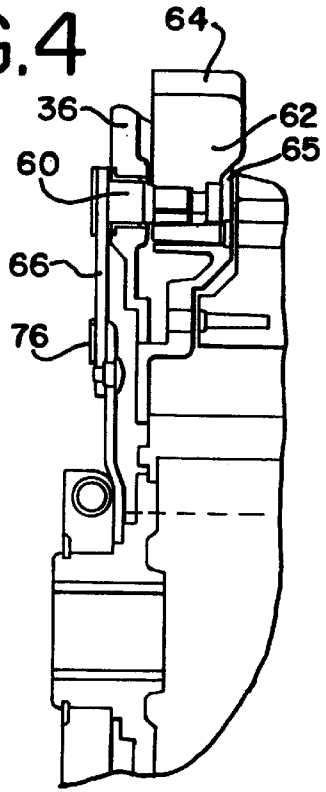
FIG. 4 is a section taken along the line 4—4 of FIG. 3.

The housing 11 of the tool includes a fixed upper blade guard 34 including outer walls 36 and 38 as seen in FIGS. 1, 2 and 4. The outer wall 38 of the upper housing preferably includes a dust port 40. The upper guard also receives a depth adjustment knob 42 connected to an arm (not shown) which is connected to the base plate 32. The knob is received in a slot 44 formed between the inner and outer walls 36, 38 of the upper guard. This particular depth adjustment mechanism is the subject of co-pending application, now U.S. Pat. No. 5,758,425, Attorney Docket 960402, and assigned to the assignee of the present application.

A lower blade guard 50 includes inner and outer walls 52 and 54, respectively, connected by an arcuate web section 56. The inner wall 52 includes a circular aperture receiving an annular hub or bearing plate 58 for mounting the lower guard for swinging movement in a plane perpendicular to the axis of rotation of the circular saw blade. In the embodiment shown, the lower guard swings about an axis coaxial with the motor output shaft.

Figure 3:
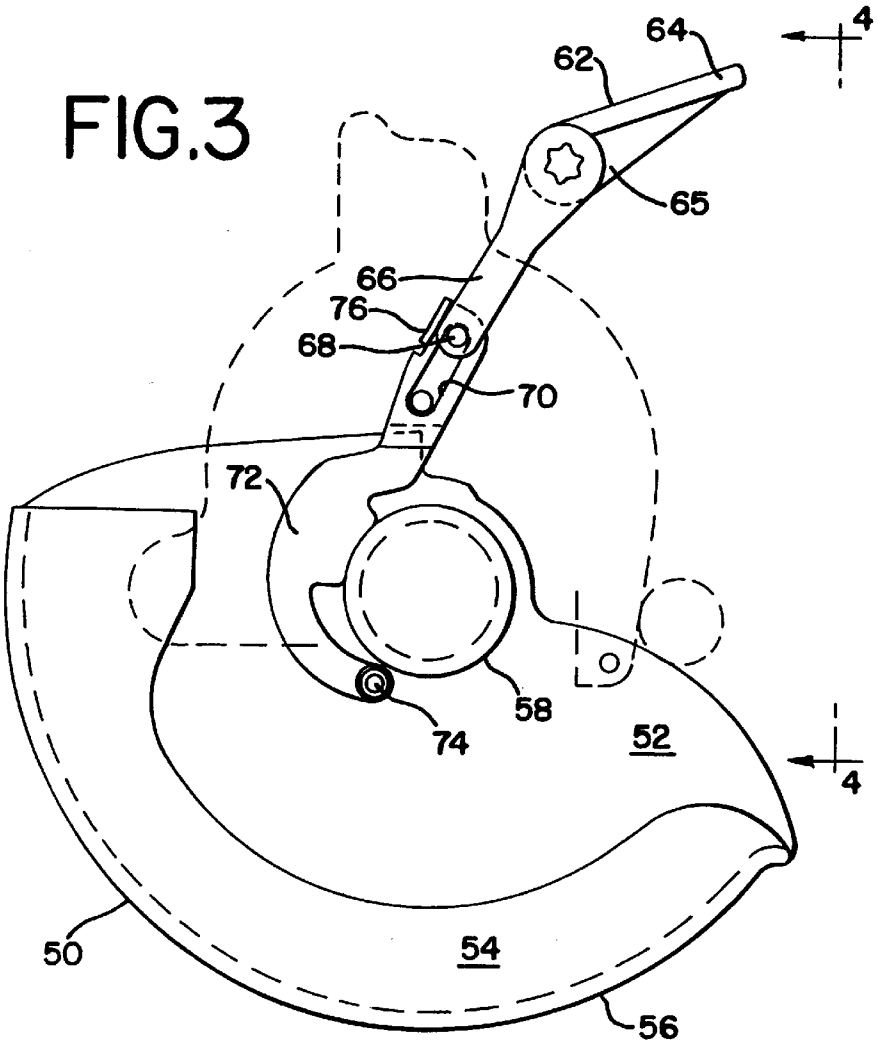
FIG. 3 is an enlarged and somewhat diagrammatic or schematic elevational view as seen from the right side of the circular saw.
Figure 5:
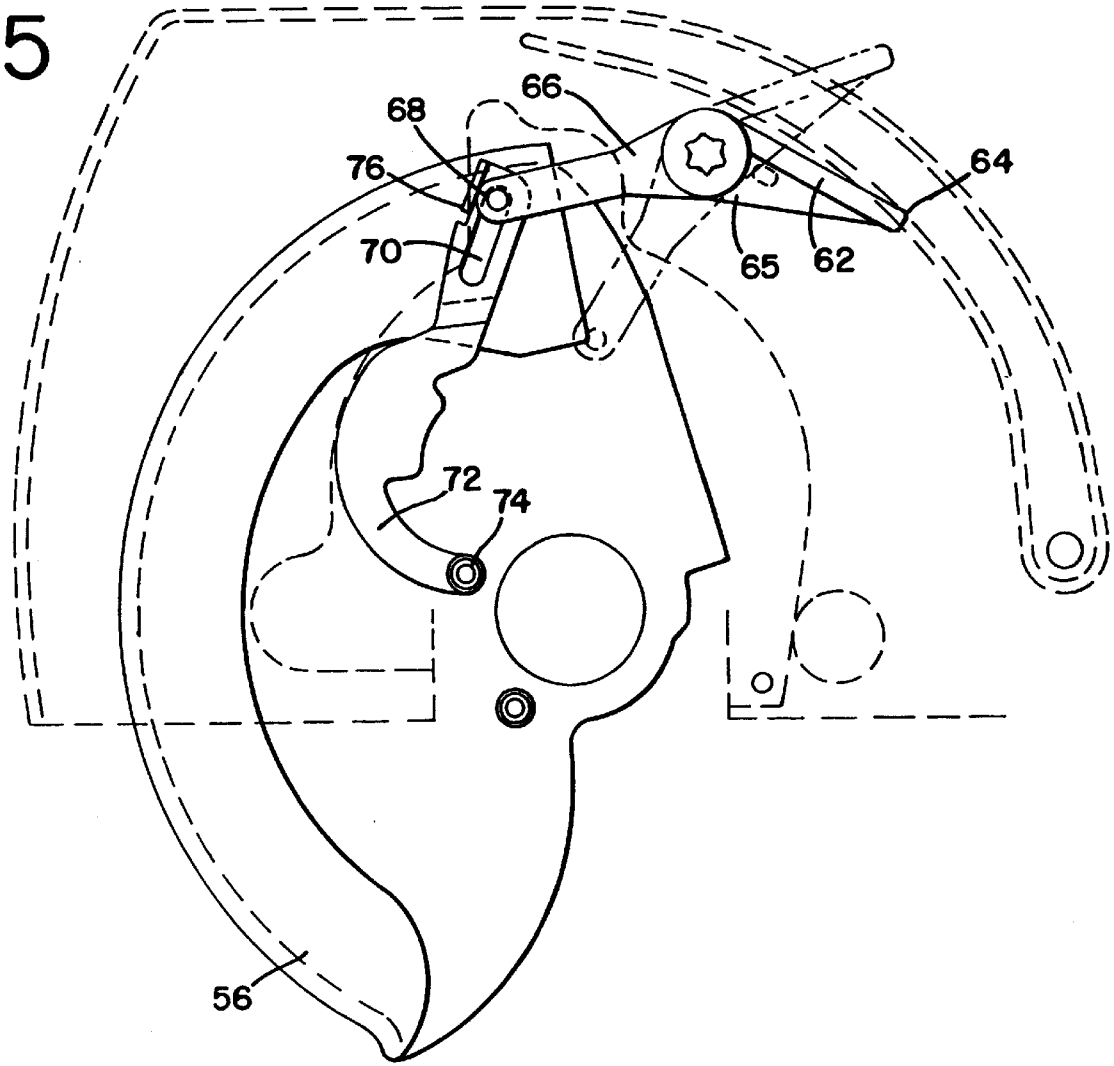
FIG. 5 is an elevational view similar to FIG. 3 but showing the lower blade guard in an intermediate position between its closed and fully opened positions.
Figure 6:
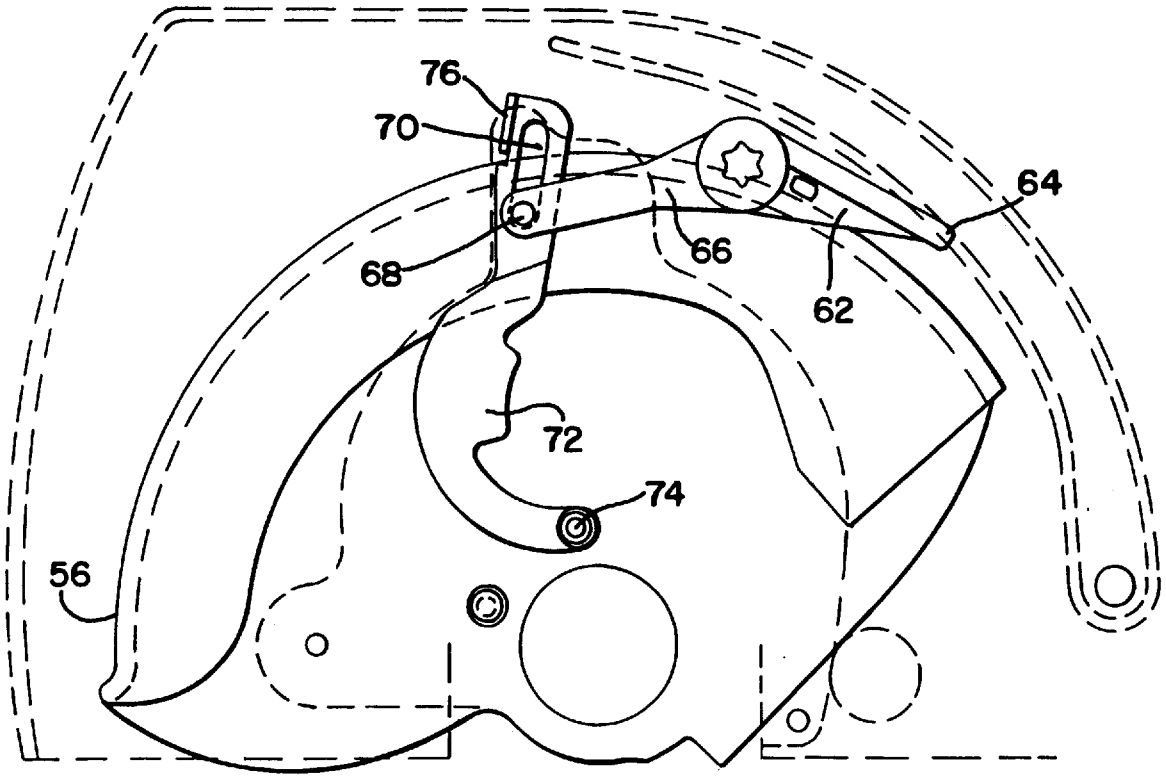
FIG. 6 is an elevational view similar to FIG. 5 but showing the lower guard in its fully retracted or fully opened position.

The blade guard 50 is shown in its closed position in FIGS. 1, 2 and 3. In the closed position, the lower blade guard cooperates with the upper blade guard to enclose substantially all of the teeth on the circular saw blade. The lower blade guard 50 is shown in its full open position in FIG. 6. It will be understood that when the lower blade guard is in its full open position, a substantial portion of the blade, defining an approximate 180 degree arc, is exposed for cutting the workpiece. FIG. 5 illustrates the lower blade guard in an intermediate position to be discussed below in connection with operation of the remote lift mechanism.

A direct lift bracket 59 is connected to the lower blade guard 50. The operator may remove one of his hands from one of the handles 20 or 28 and grasp the bracket 59 to retract the lower blade guard.

As seen in FIGS. 3 and 4, the inner wall 36 of the upper guard includes an aperture for receiving a pin 60 for rotation therein. One end of the pin is attached to a lift arm 62, which lift lever has a first distal end 64 and a second end 65. It will be understood that the lift arm 62 is fixed to the pin 60 such that rotation of the former imparts corresponding rotation to the latter. The pin 60 defines a pivot axis paralle with the axis of rotation of the motor shaft.

The arm 62 is connected to a link 66. It will be understood that the link 66 is fixed to the pin 60 such that rotation of the arm 62 will cause corresponding rotation of the link 66. The arm 62 and the link 66 together constitute a lever mounted for rotation about the axis of the pin 60.

The link 66 mounts a pin 68 received in a slot 70 formed in an arm 72. Arm 72 is pivotally connected to the wall 52 of the lower blade guard by a pin 74. A spring (not shown) is connected to the lower blade guard 50 for constantly urging the same to rotate toward its closed position, i.e., in a counterclockwise direction as seen in the drawings. It will be noted that the arm 72 includes a tab 76 bent at 90 degrees from the plane of the arm 72 for engaging a side edge of the link 66. When the lower blade guard is in its fully closed position as shown in FIG. 3, the tab 76 engages the arm of the link 66 to hold the link 66 and arm 72 in an over-center relationship as shown in FIG. 3.

It will be noted in FIGS. 1 and 2 that the distal portion 64 of the lever is mounted in adjacent relationship with the auxiliary handle 28. When the operator grasps the primary handle 20 by his right hand and then grasps the auxiliary handle 28 by his left hand, the operator's left thumb is conveniently positioned for depressing the distal end 64. When the distal end 64 is depressed for rotating the arm 62 in a clockwise direction about the pin 60, the lower blade guard will be swung in a clockwise direction from the position shown in FIG. 3 to the intermediate position shown in FIG. 5 thereby exposing a substantial number of teeth on the blade such that the operator can commence a cutting operation. As the operator continues the cutting operation, the lower blade guard will eventually come into contact with the workpiece and will rotate from the intermediate position shown in FIG. 5 to the full open position shown in FIG. 6. This additional movement of the lower guard is made possible by the lost motion connection between the arm 62 and the arm 72 by reason of the pin 68 and slot 70. After the cutting operation commences, the operator may release thumb pressure on the distal end 64 of the arm 62. It is apparent that the arm 62 and link 66 could be of unitary construction.

Thus, it is seen that the present invention provides a remote lower guard lift mechanism which can be readily operated by the left thumb of the operator while grasping the auxiliary handle with the operator's left hand.

It will be apparent to those skilled in the art that the present invention is susceptible to many changes and variations without departing from the spirit and scope of the following claims.

We claim:

1. A circular saw for powering a saw blade having a continuous peripheral series of cutting teeth, said saw having a housing enclosing a motor which drives a spindle adapted to mount the circular saw blade for rotation about a first axis perpendicular to a plane containing the blade when mounted on the spindle, an upper blade guard fixed to said housing and including an inner side and an outer side, a lower blade guard mounted by the housing for swinging movement in a plane perpendicular to said first axis back and forth between closed and opened positions, said lower blade guard, when in its closed position, cooperating with the upper blade guard to enclose substantially all of the teeth of the circular saw blade when mounted on said spindle, said lower blade guard, when in its opened position exposing a substantial peripheral portion of the blade when mounted on said spindle, said housing mounting a primary handle adjacent to the inner side of the upper blade guard, said primary handle mounting a trigger engageable by an operator's trigger finger when the operator's right hand is grasping the primary handle, said housing mounting an auxiliary handle adjacent the primary handle and graspable by the operator's left hand, a lever pivotally mounted intermediate its ends by the upper blade guard adjacent its inner side for swinging movement about a second axis parallel with said first axis, said lever including a first distal end in adjacent relationship with the auxiliary handle such that the operator's left thumb may depress the distal end of the lever while the operator's left hand is grasping the auxiliary handle thereby to rotate the lever in a first direction, said lever including a second end remote from said distal end, an arm pivotally connected at one of its ends to said second end of the lever and pivotally connected at its other end to the lower blade guard for swinging the latter from its closed position toward its opened position when said lever is rotated in said first direction, wherein one of said lever second end and said arm includes a slot and the other of said lever second end and said arm includes a pin received within the slot to permit movement of said arm when said lever is stationary.

2. The circular saw according to claim 1 wherein said lever is movable in said first direction between a first position and a second position, movement of the lever from its first position to its second position serving to swing the lower blade guard from its closed position to an intermediate position between its closed and open positions, movement of said arm relative to said lever when the latter is in its second position permitting movement of the lower blade guard from said intermediate position to said open position.

3. A circular saw for powering a saw blade having a continuous peripheral series of cutting teeth, said saw having a housing enclosing a motor which drives a spindle adapted to mount the circular saw blade for rotation about a first axis perpendicular to a plane containing the blade, an upper blade guard fixed to said housing and including an inner side and an outer side, a lower blade guard mounted by the housing for a swinging movement in a plane perpendicular to said first axis back and forth between closed and opened positions, said lower blade guard, when in its closed position cooperating with the upper blade guard to enclose substantially all of the teeth of the circular saw blade when mounted on said spindle, said lower blade guard, when in its opened position, exposing a substantial peripheral portion of the blade when mounted on said spindle, said housing mounting a primary handle adjacent the inner side of the upper blade guard, said primary handle mounting a trigger engageable by an operator's trigger finger when the operator's right hand is grasping the primary handle, said housing mounting an auxiliary handle adjacent the primary handle and graspable by the operator's left hand, a lever pivotally mounted by the upper blade guard adjacent its inner side for swinging movement about a second axis parallel with said first axis, said lever including a distal end in adjacent relationship with the auxiliary handle such that the operator's left thumb may depress the distal end of the lever while the operator's left hand is grasping the auxiliary handle thereby to rotate the lever in a first direction, said lever including a second end remote from said distal end, an arm pivotally connected at one of its ends to said lever and pivotally connected at its other end to the lower blade guard for swinging the lever from its closed position and toward its opened position when said lever is rotated in said first direction, wherein one of said lever second end and said arm includes a slot and the other of said lever second end and said arm includes a pin received within the slot to permit movement of said arm when said lever is stationary.

4. The circular saw according to claim 3 wherein said lever is movable in said first direction between a first position and a second position, movement of the lever from its first position to its second position serving to swing the lower blade guard from its closed position to an intermediate position between its closed and open positions, movement of said arm relative to said lever when the latter is in its second position permitting movement of the lower blade guard from said intermediate position to said open position.

* * * * *